US005277676A

United States Patent [19]

Holland et al.

[11] Patent Number: 5,277,676

[45] Date of Patent: Jan. 11, 1994

[54] THERAPEUTIC TRACTION APPARATUS AND METHOD

[75] Inventors: Robert A. Holland, 409 S. Glebe Rd., Arlington, Va. 22204; Gary G. Reber, Springfield, Va.

[73] Assignee: Robert A. Holland, Arlington, Va.

[21] Appl. No.: 963,640

[22] Filed: Oct. 20, 1992

Related U.S. Application Data

[63] Continuation-in-part of Ser. No. 694,501, May 2, 1991, Pat. No. 5,156,580.

[51] Int. Cl.[5] ..... A63B 1/00

[52] U.S. Cl. ..... 482/39; 482/38; 606/241; 602/19

[58] Field of Search ..... 602/19; 482/143, 38, 482/39, 43; 606/241; 128/75

[56] References Cited

U.S. PATENT DOCUMENTS

| | | | |
|---|---|---|---|
| 786,672 | 4/1905 | Pfund | 482/143 |
| 2,240,407 | 4/1941 | Masters | 482/143 |
| 4,372,552 | 2/1983 | Carlmark | 482/143 |
| 4,494,533 | 1/1985 | Sgroi et al. | 606/241 |

OTHER PUBLICATIONS

"Universal", Equipment Catalog; 1980; p. 21.

*Primary Examiner*—Richard J. Apley
*Assistant Examiner*—Lynne A. Reichard
*Attorney, Agent, or Firm*—Richard J. Johnson

[57] ABSTRACT

A method for enabling a person to apply gentle gravity traction to his spine by suspending his body by the arms while supporting some of his weight with his legs. The method, which is a modified form of "long axis-extension" gravity traction, describes a procedure wherein a trained therapist designs and supervises a treatment program unique to the individual based on a number of factors. The patient is at all times able to control the amount of weight that is applied to the injured portion. The patient is instructed in carrying out a treatment program and monitored as to progress and possible changes to the program. An apparatus is disclosed that is uniquely designed for use with the method. It is preferably constructed entirely of wood except for fastener elements and may be assembled and disassembled quickly without the use of any tools.

17 Claims, 3 Drawing Sheets

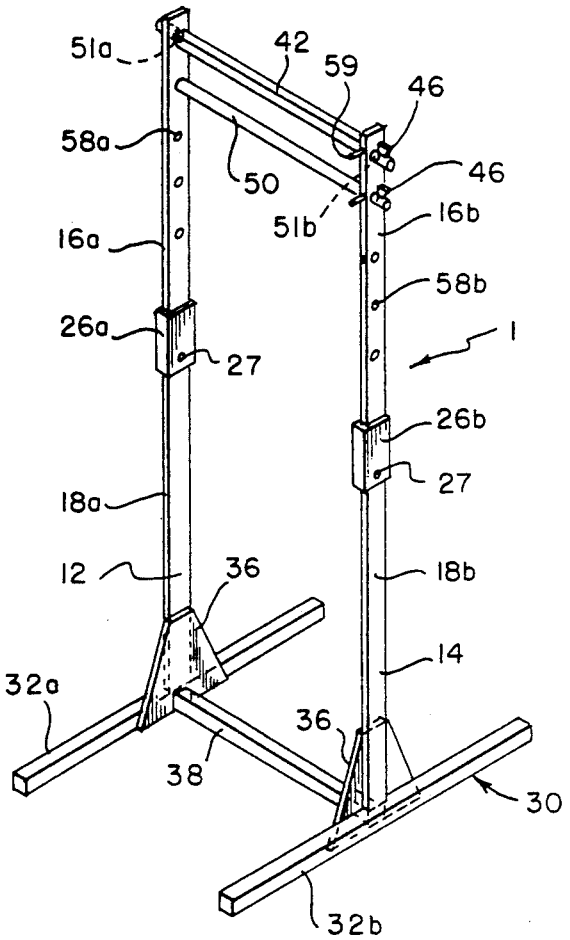
FIG. 1
FIG. 2
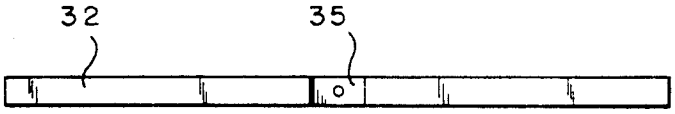
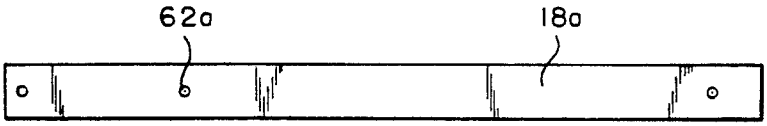
FIG. 3
FIG. 4
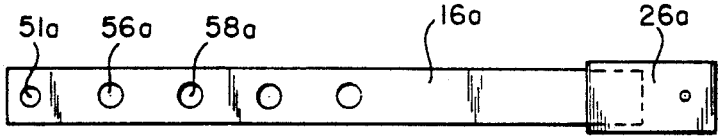
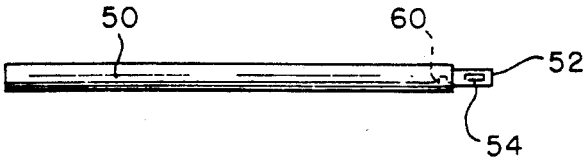
FIG. 10

FIG. 5
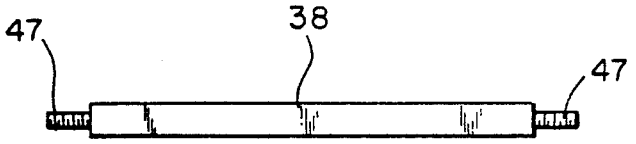
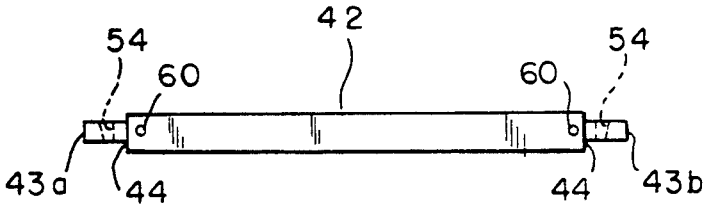
FIG. 6
FIG. 7
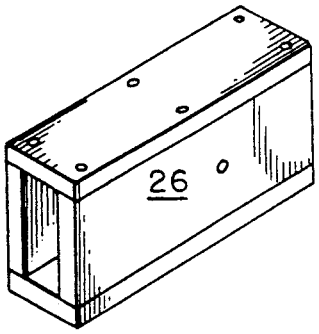
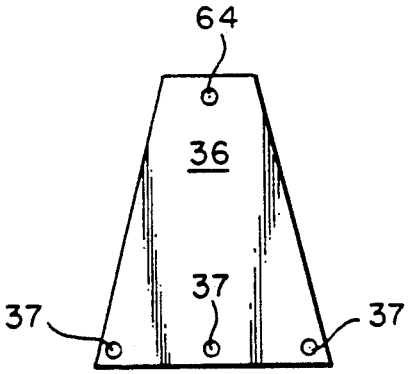
FIG. 8
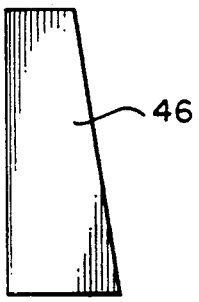
FIG. 9

THERAPEUTIC TRACTION APPARATUS AND METHOD

This is a continuation-in-part of U.S. patent application Ser. No. 07/694,501, filed May 2, 1991, now U.S. Pat. No. 5,156,580.

BACKGROUND OF THE INVENTION

This invention relates to a method for enabling a person to apply gentle traction to the human spine by suspending the body by the arms while supporting some of his weight with his legs. The procedure of hanging by the hands and using gravity to provide traction forces to the spine is termed long axis extension. A trained therapist will design a specific treatment program for the patient based on a number of factors and thereafter instruct and monitor the progress of the patient.

2. Description of the Related Art

The prior art includes a number of devices that have been proposed for hanging by the arms. Examples of such include:

Carlmark, U.S. Pat. No. 4,372,552 discloses a hang stand wherein a user hangs by his hands while a support behind his back maintains his spine in a correct alignment.

Bushnell, U.S. Pat. No. 4,241,914 discloses an exercise apparatus for a person hanging by his arms wherein a resistance member attached to the frame near his feet may increase or decrease the amount of weight supported by his arms.

Simon, U.S. Pat. No. 3,896,798 discloses a therapeutic traction apparatus wherein a user hangs by his shoulders from a pair of parallel bars. Footrests are provided to initially position himself and for rest.

Steele, U.S. Pat. No. 3,975,106 discloses a tapered wedge used to assemble scaffolding members.

Other U.S. Pat. Nos. of general interest are: 4,772,011, 3,642,278, 3,707,285, 3,944,219, 2,932,510, 860,517, 4,503,845, 1,495,536, and 4,657,232.

SUMMARY OF THE INVENTION

The prior art has recognized that hanging by the arms can be beneficial in assisting the rehabilitation of a person with an injured spine. However, the various known hanging devices do not appear to recognize the hazards involved when a user with an injured spine attempts to support his entire weight with his arms or if while doing so he suddenly changes the loading forces on the injured spinal discs such as upon release of his hands and dropping to the floor.

In order to compensate for the potential difficulties arising from full weight-bearing hanging (feet entirely free from the floor), a modification of known techniques for implementing this exercise is important. Some of the potential dangers to the user arising from full weight-bearing hanging include: trauma to shoulder articulation and/or attached soft tissue; exacerbation of the symptoms as a result of the sudden increase of compressive forces on the spine, especially in cases of acute low back inflammation, upon the release of the hands and the ensuing drop of the body to the floor.

Applicant has discovered a more gentle method of stretching the elastic soft tissues (muscles, fascia) that provide support to the axial skeleton, in particular the lumbo-pelvic section. The end result of the improved method is that the bodies response to gravity will produce decompression and partial unloading of the compression forces and allow for a fuller range of motion at the spinal segmental level without the inherent dangers of the prior art methods and hanging devices.

Thus, the invention relates in part to a method, and in part to an apparatus, that will allow the user to gently and gradually shift a desired portion of the compressive forces to his spine to gentle tension forces while maintaining a proper alignment of his spine and his thighs to reduce the possibility of further injury to the person.

As is well known, persons experiencing severe back pain may be in severe discomfort for a period of time following a back injury even so as to be unable to walk and thus travel to a doctor's office where treatment could be performed. When the patient is able to be diagnosed by the therapist a treatment program is designed for the patient depending upon a variety of factors. After such has been done and the patient has been fully instructed in the program he may be given the frame apparatus to be taken to his home or office for carrying out his treatment program.

The method and apparatus fulfills a need for practitioners, such as chiropractors, to have available a method of treating back injuries and a hanging apparatus that can be easily transported to a patient's home and assembled by unskilled persons in a minimum of time and effort for treating injured patients. To such end the apparatus is designed to occupy a minimum of space and require no additional support from walls, ceilings, or doors as is required in many prior art devices. Because of the unique design the apparatus will have special usefulness in doctors' offices particularly in instructing the patient in a treatment program.

Individual apparatus frame members are designed to be light in weight and easily assembled and disassembled by persons who may be unskilled mechanically without the use of tools of any kind. The device is designed to be sturdy in use and to occupy a minimum of space when assembled either in a doctor's office or in a patient's home.

A primary object of the invention is to provide a method and an apparatus by which a person may hang by his arms with a portion of the weight sustained by his legs and which may be quickly assembled and disassembled so as to be easily stored or transported and reassembled with a minimum of time and effort.

A further object is to provide a method of using a hanging frame to maximize the benefits therefrom.

A further object is to provide an improved method of using a hanging apparatus to relieve spinal discomfort and to gently alleviate spinal injuries and abnormalities. These and other objects will become apparent from the description which follows.

BRIEF DESCRIPTION OF THE DRAWINGS

FIG. 1 is a perspective view of the assembled hanging frame.

FIG. 2 is a front view of the bottom rail.

FIG. 3 is a side view of the lower portion of one of the side frame members.

FIG. 4 is a side view of the upper portion of one of the side frame members.

FIG. 5 is a side view of the base stretcher member.

FIG. 6 is a side view of one of the hanging stretcher members.

FIG. 7 is a perspective view of the connecting sleeve.

FIG. 8 is a front view of the base reinforcing member

FIG. 9 is a front view of one of the securing wedges.

FIG. 10 is a front view of the hanging bar.

DETAILED DESCRIPTION OF THE INVENTION

Figure 11:
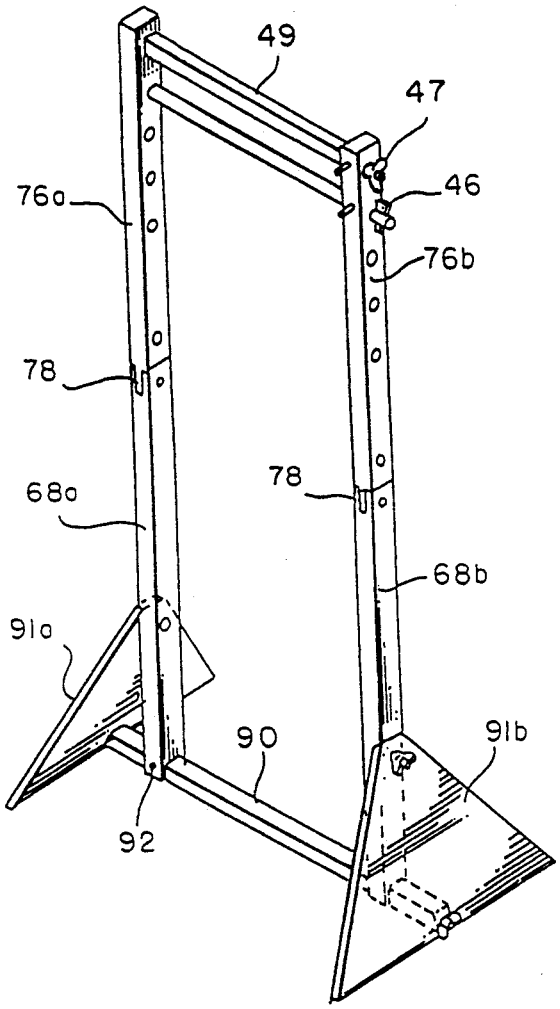
FIG. 11 is a perspective view of a modified structure.

In the drawings, like numbers represent like parts, with letters being added to such numbers where necessary to facilitate describing the invention. Reference will now be made to the drawings for a detailed description of the invention with the use of such numerals. Referring first to FIG. 1, the hanging frame apparatus is referred to in general by the numeral 10. Hanging frame 10 is preferably constructed almost entirely from wood, although it could obviously be constructed from other well known materials. As best viewed in FIG. 1 the frame includes left and right vertical side support rail members 12 and 14, respectively. For convenience the left side components include the letter "a" while right side components are given the letter "b." Left side support member 12 includes an upper portion 16*a* and a lower portion 18*a*. Support member 14 includes an upper portion 16*b* and a lower portion 18*b*, respectively. The upper and lower rail portions are removably joined at their central portions by sleeve members 26*a*, 26*b* which are generally in the form of hollow rectangular boxes. Each sleeve member is attached in a substantially permanent manner to a respective upper portion 16*a*, 16*b* and is removably secured to the lower half portion 18*a*, 18*b*, by fastening means, such as a single bolt and wing nut illustrated at 27.

The support base 30 includes a pair of laterally spaced bottom rails or feet 32*a*, 32*b* each secured at a respective central portion to the lower end of a respective lower side support member 18*a*, 18*b* which is received in recessed portion 35. A triangularly shaped gusset stiffener brace 36 is positioned on the inner surfaces of the feet 32*a*, 32*b* and the lower side support members 18*a*, 18*b*, and is removably secured thereto with bolts and wing nuts 27. A base spreader bar 38 having a threaded stud 47 in and projecting from each end is positioned between the spaced feet with the respective studs 47 passing through aligned openings in the braces 36, lower members 18*a*, 18*b*, and feet 32*a* 32*b*. Wing nuts 27 (not shown in FIG. 1) threaded to studs 47 securely but removably clamp these members. The base spreader bar 38 thus maintains the side rails a fixed distance apart.

Positioned between and securing the upper ends of the side rail support members 12, 14, is an upper spreader bar 42. Bar 42 has reduced diameter end portions 43*a*, 43*b*, slidably received in the upper set of aligned holes 51*a*, 51*b*. The reduced diameter end portions provide shoulders 44 that abut the inner surfaces of the side rail members to fix the distance therebetween. End portions 43*a*, 43*b*, include diametrically disposed rectangular openings 54 (see FIG. 6) having tapered outer end walls to receive tapered wedge members 46 which serve to removably fix the upper spreader bar and the upper ends of the side rail members in position.

A second or hanging bar 50, (see FIG. 10) which is circular in cross-section, has a reduced diameter portion 52 on one end. It will be noted that the openings 58*a* in rail member 16*a* are of larger diameter than the openings 58*b* in rail member 16*b*. Thus, the nonreduced end of the hanging bar 50 is merely slidably received in a selected one of the openings 58*a* in the upper side rail 16*a* whereas the opposite reduced diameter end 54 is inserted in a correspondingly sized opening 58*b*. The reduced diameter portion 52 also includes a diametrically disposed opening 54 to receive a tapered wedge member 46. A metal pin 59 is inserted through an opening in an edge portion of at least one of the side rails 16*a* or 16*b* and into a diametrical opening 60 in the hanging bar 50 to keep it from rotating. A similar pin 59 may be used at each end of the upper spreader bar 42 to keep the bar from rotating and thus prevent the accidental removal of the wedge member 46.

ASSEMBLING THE HANGING FRAME

To assemble the frame, the feet 32*a*, 32*b* are placed on a flat surface. The lower ends of the respective rail portions 18*a*, 18*b*, are placed in the recesses 35 and fixed in position using a gusset brace 36 and secured with bolts and wing nuts 27. The threaded studs 47 of the base spreader 38 are then inserted through the openings 37 in the gusset braces and the aligned openings in the lower rail portions 18*a*, 18*b*, and feet 32*a*, 32*b*, respectively and secured using a single wing nut on each end. The lower ends of the upright support members 18*a*, 18*b* are rigidly secured using a single bolt passed through the spaced holes 62*a*, 62*b*, therein and upper openings 64 in the gusset braces 36. Additional reinforcement such as gussets may be provided at this connection to reduce the possibility of lateral sway of the rail members.

The upper support portions 16*a*, 16*b*, having a connecting sleeve 26*a*, 26*b*, respectively, fixedly attached thereto, are telescoped over the upstanding ends of the lower support rail portions 18*a*, 18*b* and are secured with a single bolt and wing nut assembly 27. Next, the reduced ends of the spreader bar 42 are inserted in the uppermost openings 51*a*, 51*b*. A tapered wedge 46 is then inserted with slight finger pressure into each opening 54. The wedges are self-tightening and require very little pressure to force them into the openings 54. Finally, the reduced end 54 of the hanging bar 50 is inserted through a selected opening 56*a* in left side rail frame 16*a* and across the opening in the frame into an aligned but smaller diameter opening 56*b* in the right side rail 16*b* until the shoulder thereon abuts the inner surface of the side rail whereupon a tapered wedge 46 is inserted in the elongated opening 54. Lock pins 59 are then inserted in openings 60 in each of the bars to prevent them from rotating. The hanging stand is then ready to be used. Disassembly of the frame for transport or storage is readily accomplished by reversing the above procedure.

MODIFICATION

In FIG. 11, a modified hanging stand is illustrated. This embodiment is generally similar to the previously described structure with a few exceptions. Sleeve member 26 is replaced with a tongue and groove connection 78 secured by a single bolt and wing nut. This connection may be reinforced by a plate 79 secured by screws over the front and rear of the joint as illustrated on the right side of FIG. 1.

The modified support base includes left and right generally triangular panel members or feet 91*a* and 91*b*, respectively. Modified spreader bar 90 extends beyond the side rail members and includes a threaded stud projecting from each end thereof which is inserted into an opening in the lower edge of the respective panel members and secured by a wing nut. A bolt and wing nut 92 may be used to secure the lower ends of the side rail members to the base spreader bar 90. The outer ends of the spreader bar 90 are angled inwardly and upwardly to conform to the angled inner faces of the panel members 91*a*, 91*b*. The upper spreader bar 49 has threaded studs 47 projecting from the ends thereof which extend through the side members and are secured by wing nuts 47. The ends of the spacer bar 49 act as shoulder spacer members for the side rail members at the upper ends thereof.

The modified hanging stand is assembled and disassembled in a manner similar to the first embodiment. As in the first embodiment, no tools are needed for such assembly or disassembly.

METHOD OF USING THE APPARATUS

The apparatus described above has been designed particularly to be used with the method of treating spinal injuries and abnormalities described below. The disclose method is directed to a series of interrelated steps and procedures involving a patient, a trained therapist and an apparatus, such as described above. While the basic method steps will be used for each patient the specific treatment program given in each instance will be unique in that it will be based on a number of factors specific to the individual. The therapist will devise the initial treatment program and then instruct and monitor the progress of the patient, making changes to the program as necessary.

Figure 12:
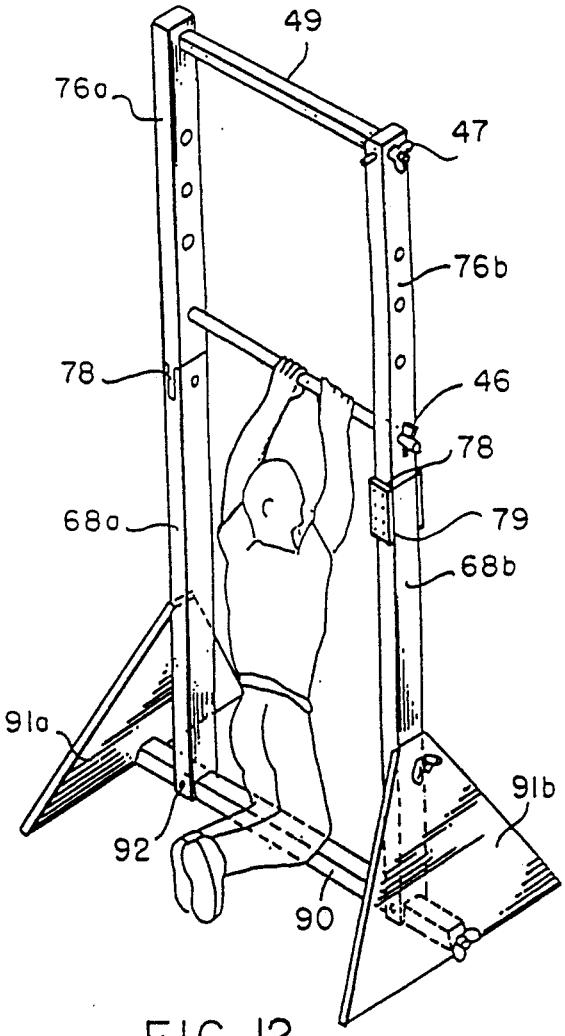
FIG. 12 illustrates the position of a user's body while practicing the method and hanging from the frame.

As stated, the treatment program prescribed by the therapist will be based on a number of factors. These will include the age, strength, height and weight of the patient, and the severity, acuteness and chronicity of the injury, and a diagnosis of the low back condition. The diagnosis may include a radiographic examination, and other standard orthopedic tests. Based on these factors the therapist will design a unique treatment program that will include, (1) apparatus hanging bar height, (2) patient hanging time, (3) frequency of treatment, and (4) other technique specific to his or her condition. Whereas one patient may be directed to hang for a few seconds with his knees slightly bent, feet flat on the floor, another may be instructed to hang for thirty seconds with only his toes on the floor as is illustrated in FIG. 12. In another situation, or possibly after a period of more gentle therapy, the patient may be instructed to hang for one minute entirely supported by his arms carefully transferring his weight from his legs while in a standing tip-toe position. Each diagnosis of low back dysfunction is unique, necessitating individual instruction and supervision from a trained therapist. The patient will then carry out the program usually at the office of and under the supervision of the therapist. However, since the apparatus is readily portable it can be transported to the patients home, office or other location.

Having been fully instructed in a treatment program and monitoring procedures the patient, if appropriate, may transport the apparatus to his home and assemble it in a convenient location, such as a bedroom, where it will be used. The patient then provides an appropriately located timing device and adjusts the height of the hanging bar 50 to the prescribed height. If the prescribed height is similar to that illustrated in FIG. 12 the patient will position himself as shown such that when hanging by his hands his thigh portions are generally aligned with his spine and his lower leg portions are generally horizontal and parallel to the floor. In this particular position, the feet are generally perpendicular to the floor with only the toes contacting the floor. As illustrated in FIG. 12, the recommended position for the legs in all hanging situations is to have them located together throughout the treatment. The arms should be less than shoulder width apart. It is apparent that by changing the height of the bar 50, the user will alter the amount of weight supported by his legs and thus the extension forces applied to the soft connecting tissue of the spine.

In all positions of treatment it is possible for the patient to have his feet or toes either in contact with or easily engageable with the floor while maintaining correct alignment of the spine. The vertically adjustable bar and stable floor support permit the patient to slowly transfer his weight to and from his arms without sudden or abrupt shocks on the injured portion. Also, the danger of a sudden release of the hands upon termination of the session with the resulting drop of the body to the floor or other support with damaging results is substantially eliminated.

The above described method and procedure is of particular benefit to the often injured lumbo-pelvic region wherein skeletal misalignment and injured tissue can be extremely painful. The result of the described procedure is a gentle controlled stretching of the elastic tissues that provide axial support to the skeleton leading to a restoration of skeletal alignment and healing of the injured tissue.

We claim:

1. A method of treating aberrant structural mechanical lumbo-pelvic spinal conditions by hanging by the arms under the influence of gravity comprising: providing a height adjustable hanging support whereby a person may hang by his arms, adjusting the height of the support until it is less than the distance from the floor to the vertically upraised hands of the patient hanging by his arms in a free unrestricted vertical position under patient controlled conditions with his thighs generally aligned with his spine and with his lower leg portions extending rearwardly generally parallel to the floor and with his feet generally perpendicular to the floor and toes supported on the floor, grasping the hanging support with his hands positioned less than shoulder width apart and hanging by his arms in the above described patient controlled position while supporting a portion of his weight with his legs.

2. The method of claim 1 including the step of assembling the hanging support just prior to its use.

3. The method of claim 2, including the step of assembling the hanging support without the use of tools.

4. The method of claim 1, wherein the hanging support is constructed substantially entirely from wood.

5. The method of claim 1 including the subsequent step wherein the position the bar is raised and the patient hangs with his feet entirely off the floor.

6. A method of treating a patient who has been substantially incapacitated as a result of an aberrant structural mechanical lumbo-pelvic spinal condition comprising: transporting an unassembled height adjustable hanging support to the vicinity of the substantially incapacitated patient, assemblying the hanging support at a location near the patient, adjusting the height of the hanging support until it is less than the distance from the floor to the vertically upraised hands of the patient hanging by his arms in a free unrestricted vertical position under patient controlled conditions with his thighs generally together and with his knees bent and feet supported on the floor, grasping the hanging support with his hands positioned less than shoulder width apart and hanging by his arms in the above described patient controlled position while supporting a substantial portion of his weight with his legs, subsequently lowering the height of the bar and increasing the proportion of body weight carried by the arms by positioning the legs such that the patients lower leg portions are generally parallel to the floor, his feet are generally perpendicular to the floor, and only his toes are touching the floor.

7. The method of claim 6, wherein the step of assembling the hanging support does not include the use of tools.

8. The method of claim 6, wherein the hanging stand is constructed substantially entirely from wood.

9. The method of claim 6 wherein the lower leg portions of the person hanging by the arms extend rearwardly generally parallel to the floor and with the feet generally perpendicular to the floor and toes supported on the floor.

10. The method of claim 6 including the step of having a trained therapist construct a treating program based on an individual analysis of the personal physical condition of person and wherein the program includes a recommended bar height, and time period of hanging.

11. The method of claim 6 including the initial step of having a trained therapist design a treatment program based on an analysis of the personal physical condition of the patient and wherein the program includes a recommended bar height, and time period of hanging.

12. A method of treating aberrant structural mechanical lumbo-pelvic spinal conditions by hanging by the arms under the influence of gravity comprising: providing a height adjustable hanging support whereby a patient may hang by his arms, adjusting the height of the support until it is less than the distance from the floor to vertically upraised hands of the patient hanging by his arms in a free unrestricted vertical position under patient controlled conditions with his thighs generally together and aligned with his spine and with his knees bent and feet supported on the floor, grasping the hanging support with his hands positioned less than shoulder width apart and hanging by his arms in the above described patient controlled position while supporting a substantial portion of his weight and his legs, subsequently lowering the height of the bar and increasing the proportion of body weight carried by the arms by positioning the legs such that the patients lower leg portions are generally parallel to the floor, his feet are generally perpendicular to the floor, and only his toes are touching the floor.

13. The method of claim 12 including the step of assembling the support just prior to its use.

14. The method of claim 13, including the step of assembling the hanging support without the use of tools.

15. The method of claim 12, wherein the hanging support is constructed substantially entirely from wood.

16. The method of claim 12 including an initial step of having a trained therapist design a treatment program based on an analysis of the personal physical condition of the patient and wherein the program includes a recommended bar height, and time period of hanging.

17. The method of claim 12 including the subsequent step of hanging wherein the position the bar is raised to permit the patient to hang with his feet entirely off the floor.

* * * * *